2/14/84 AU 166 EX
XR 4,431,513

United States Patent [19]

Lewis

[11] 4,431,513

[45] Feb. 14, 1984

[54] METHODS FOR PRODUCING MESOPHASE PITCH AND BINDER PITCH

[75] Inventor: Irwin C. Lewis, Strongville, Ohio

[73] Assignee: Union Carbide Corporation, Danbury, Conn.

[21] Appl. No.: 363,558

[22] Filed: Mar. 30, 1982

[51] Int. Cl.[3] ..... C10C 1/00; C07C 2/02; C07C 13/28

[52] U.S. Cl. ..... 208/44; 208/22; 252/99

[58] Field of Search ..... 208/22, 44; 423/449, 423/447.2, 447.4, 447.6; 585/422, 425; 528/396

[56] References Cited

U.S. PATENT DOCUMENTS

| | | | |
|---|---|---|---|
| 2,255,396 | 9/1942 | Sparks | 585/422 |
| 2,268,602 | 1/1942 | Lichtenstern | 208/44 |
| 3,006,972 | 10/1961 | Fields | 585/422 |
| 3,109,868 | 11/1963 | Fields | 585/422 |
| 3,223,618 | 12/1965 | Convery | 208/44 |
| 3,373,101 | 3/1968 | Folkins | 208/22 |
| 4,146,576 | 3/1979 | Wyss | 423/447.4 |
| 4,317,809 | 3/1982 | Lewis et al. | 423/447.1 |

FOREIGN PATENT DOCUMENTS

| | | | |
|---|---|---|---|
| 11439 | 2/1934 | Australia | 208/22 |
| 891474 | 1/1972 | Canada | 208/44 |
| 166611 | 10/1980 | European Pat. Off. | 208/44 |
| 520525 | 4/1940 | United Kingdom | 208/44 |
| 1356566 | 6/1974 | United Kingdom | 208/44 |
| 1356569 | 6/1974 | United Kingdom | 208/44 |

OTHER PUBLICATIONS

P. Kovacic et al., p-Polyphenyl from Benzene-Lewis Acid Catalyst-Oxidant, (1965), pp. 100-103, J. Org. Chem., vol. 30.

D. S. Newman, Reaction of Coal and Model Compounds in Room Temperature Molten Salt Mixtures, (1980), pp. 1647-1649, Electrochemical Society Preprint.

*Primary Examiner*—Delbert E. Gantz
*Assistant Examiner*—Helane E. Maull
*Attorney, Agent, or Firm*—David Fink

[57] ABSTRACT

A method of producing a pitch or a coke, comprising reacting an aromatic hydrocarbon with anhydrous $AlCl_3$ and an acid salt of an organic amine which acid salt reduces the activity of the $AlCl_3$, and is miscible with the $AlCl_3$ to form a molten eutectic salt mixture reactive with the aromatic hydrocarbon.

16 Claims, No Drawings

METHODS FOR PRODUCING MESOPHASE PITCH AND BINDER PITCH

The invention relates to mesophase pitch, binder pitch and coke and to methods for producing the pitches and coke.

It is well known that carbon fibers having excellent mechanical properties suitable for commercial exploitation can be produced from spinnable mesophase pitches. The mesophase pitch derived carbon fibers are light weight, strong, stiff, electrically conductive, and both chemically and thermally inert. The mesophase pitch derived carbon fibers perform well as reinforcements in composites and have found use in aerospace applications and quality sporting equipment.

Generally, carbon fibers have been primarily made commercially from three types of precursor materials; rayons, polyacrylonitrile (PAN), and pitch. The use of pitch as a precursor material is attractive economically.

Low cost carbon fibers produced from isotropic pitch exhibit little preferred molecular orientation and therefore have relatively poor mechanical properties.

In contrast, carbon fibers produced from mesophase pitch exhibit high preferred molecular orientation and excellent mechanical properties.

As used herein, the term "mesophase" is to be understood as used in the instant art and generally is synonymous with liquid crystal. That is, a state of matter which is intermediate between crystalline solids and normal liquid. Ordinarily, material in the mesophase state exhibits both anisotropic and liquid properties.

As used herein, the term "mesophase pitch" is a pitch containing more than about 40% by weight mesophase and is capable of forming a continuous anisotropic phase when dispersed by agitation or the like in accordance with the prior art.

A conventional method for preparing a mesophase pitch suitable for forming a highly oriented carbon fiber includes the step of subjecting a precursor pitch to a thermal treatment at a temperature greater than about 350° C. to effect thermal polymerization. This thermal process results in the polymerization of molecules to produce large molecular weight molecules capable of forming mesophase. The criteria for selecting a suitable precursor material for the conventional method is that the precursor pitch be capable of forming a mesophase pitch which under quiescent conditions has large coalesced mesophase domains. The domains of aligned molecules must be greater than about 200 microns. This criterion is set forth in the prior art and has been found to be essential for determining a spinnable mesophase pitch suitable for commercial operations.

A typical conventional method is carried out using reactors maintained at about 400° C. for from about 10 to about 20 hours. The properties of the final material can be controlled by the reaction temperature, thermal treatment time, and volatilization rates. The presence of the high molecular weight fraction results in a melting point of the mesophase pitch of at least about 300° C. An even higher temperature is needed to transform the mesophase pitch into fibers. The operation is termed "spinning" in the art.

The amount of mesophase in a pitch can be evaluated by known methods using polarized light microscopy. The presence of homogeneous bulk mesophase regions can be visually observed by polarized light microscopy, and quantitatively determined by published methods.

Polarized light microscopy can also be used to measure the average domain size of a mesophase pitch. For this purpose, the average distance between extinction lines is measured and defined as the average domain size. To some degree, domain size increases with temperature up to about coking temperature. As used herein, domain size is measured for samples quiescently heated without agitation to about 400° C.

Softening point or softening temperature of a pitch, is related to the molecular weight constitution of the pitch, and the presence of a large amount of high molecular weight components generally tends to raise the softening temperature. It is a common practice in the art to characterize in part a mesophase pitch by its softening point. The softening point is generally used to determine suitable spinning temperatures. A spinning temperature is about 40° C. or more higher than the softening temperature.

Generally, there are several methods of determining the softening temperature and the temperatures measured by these different methods vary somewhat from each other.

Generally, the Mettler softening point procedure is widely accepted as the standard for evaluating a pitch. This procedure can be adapted for use on mesophase pitches.

The softening temperature of a mesophase pitch can also be determined by hot stage microscopy. In this method, the mesophase pitch is heated on a microscope hot stage under an inert atmosphere under polarized light. The temperature of the mesophase pitch is raised at a controlled rate and the temperature at which the mesophase pitch commences to deform is noted as softening temperature.

The conventional thermal polymerization process for producing mesophase pitch has several drawbacks. There is considerable cost for the energy to provide the heat over the extended period of time necessary to bring about the thermal polymerization. In addition, the choice of precursor materials is limited, particularly for commercial production.

The use of a novel thermal-pressure treatment is described in U.S. Pat. No. 4,317,809 to I. C. Lewis et al for enabling the use of some materials previously considered unsuitable for the production of mesophase pitches.

Recently, the entire thermal polymerization process has been avoided by the use of a solvent extraction process which can be carried out on a precursor pitch to obtain a mesophase pitch without any heating whatsoever. The solvent extraction process, however, has the limitation in that the precursor material must be a pitch which includes mesophase components. Generally, the solvent extraction process has yields of from 10% to 20% by weight. The yields, however, can be increased substantially to about 40% by weight or more by the use of a preliminary heat treatment.

The applicant realized that it would be advantageous to control the polymerization process in order to produce mesophase pitch in high yields from very low molecular weight precursor materials. According to the prior art, many of these precursor materials are entirely unsuitable for producing mesophase pitch. Moreover, even if mesophase pitch were produced from such precursor materials, then the carbon fibers derived from these mesophase pitches would have poor mechanical properties. Surprisingly, a novel mesophase pitch was discovered.

In the article, entitled "p-Polyphenyl from Benzene-Lewis Acid Catalyst-Oxidant. Reaction Scope and Investigation of the Benzene-Aluminum Chloride-Cupric Chloride System" by Peter Kovacic and James Oziomek, J. Org. Chem., Vol. 29 pp. 100–103 (1965), a weak Lewis acid catalyst-oxidant comprising $AlCl_3$ and $CuCl_2$ is used to prepare polyphenyl polymers from benzene. The polymerization takes place through the formation of connecting single bonds between benzene molecules. This type of polymerization occurs without condensation. The polyphenyl polymers produced according to this article are infusible and do not melt when carbonized. Such materials are unsuitable for producing mesophase pitch according to the prior art. Other forms of polyphenyl polymers have been prepared by other methods and are capable of producing a glassy carbon.

As used herewith, the term "couple" or "coupling" in connection with polymerization shall mean the formation of a single bond between two reacting molecules and a molecular chain having such bonds, can include more than two starting molecules.

Japanese Patent Application No. 81664-1974 relates to a method of manufacturing modified pitch and/or carbon using a molten salt system containing a strong Lewis acid and a non-reactive alkali halide to treat a selected material such as pitch. The Japanese application relies on the use of an ionic medium in which polymerization is achieved by the strong Lewis acid with the second component establishing a eutectic solution having a relatively low melting point. It is a requirement that the second component combine only physically with the strong Lewis acid and that it does not form a chemical complex with the strong Lewis acid. The process of the Japanese application effects aromatic condensation and thereby leads to the formation of discotic molecules. The mesophase pitch produced by thermal polymerization is also known to consist of discotic molecules.

As used herein, the term "condensation" as used in connection with polymerization between aromatic molecules is characterized by the establishment of at least two new bonds between the co-reacting molecules. This reaction, of course, is contrasted to coupling polymerization in which only single bonds are formed between co-reacting molecules.

In the article, "Reactions of Coal and Model Coal Compounds in Room Temperature Molten Salt Mixtures" by David S. Newman, Robert L. McBeth, and Randall E. Winans, Electrochemical Society Preprint, Abstract No. 660 (1980), there is disclosed the use of a $AlCl_3$-pyridine hydrochloride mixture which is molten at or near room temperature and which serves as a reaction media for coal and model coal compounds. The article concludes that the pyridine hydrochloride lowers the temperature at which $AlCl_3$ catalyzes the alkylation reactions and that the mixture may be a useful reaction media for coal decomposition and transformation reactions.

One of the embodiments of the invention includes a method of producing a mesophase pitch having ellipsoidal molecules. This mesophase pitch has novel properties and is entirely different from the prior art mesophase pitch.

As used herein, "ellipsoidal" refers to the general shape of a molecule having an approximately elliptical cross section in the plane of the molecule with an aspect ratio greater than 1:1, preferably greater than 2:1.

The mesophase pitch having ellipsoidal molecules is produced by the polymerization of an aromatic pitch in which the coupling polymerization constitutes at least 60% of the polymerization reactions.

The instant process invention for producing a pitch or coke product features a polymerization reaction of a polynuclear aromatic hydrocarbon containing at least one condensed ring to produce the product.

Preferably, the invention relates to the polymerization of an aromatic hydrocarbon containing at least two condensed rings, comprising reacting the aromatic hydrocarbon with anhydrous $AlCl_3$ and an acid salt of an organic amine which acid salt reduces the activity of the $AlCl_3$, and is miscible with the $AlCl_3$ to form a molten eutectic salt mixture reactive with the aromatic hydrocarbon. A eutectic mixture has a melting point lower than its components.

The product from the instant process can range from being a non-mesophase pitch suitable for use as an impregnant or binder for electrodes, or an improved precursor material for use in prior art processes for producing mesophase pitch, or a coke.

The aromatic hydrocarbon for the process can be selected from a broad range of materials so that the process allows the use of inexpensive materials and thereby provides economy for commercial practice. The process also allows the use of aromatic hydrocarbons and pitches which are normally insoluble as precursors for mesophase pitch and coke because of either their small size or unfavorable chemical structure.

The acid salt suitable for the invention includes pyridine hydrohalides, aniline hydrohalides, and methylamine hydrohalides. Other suitable acid salts can be determined by the criteria given herein after some experimentation.

The $AlCl_3$ and acid salt of the invention combine to form a weak Lewis acid.

One of the advantages of the invention is that the process does not utilize organic solvents which are difficult to separate from the starting compound. A second advantage is that only a single inorganic compound is used leading to little contamination in the pitch or mesophase pitch products. Such contamination is generally undesirable for the preparation of fibers or for use of the material in electrodes.

Generally, a binder or impregnant pitch is produced by terminating the reaction before the formation of mesophase so that the product has a softening point of about 120° C. or less and a modified Conradson carbon content of at least about 50%.

A surprising aspect of the instant invention is that very high yields for producing mesophase pitch are possible. Yields of 80% to 90% by weight can reasonably be expected for the process.

The degree of polymerization of the process according to the invention depends upon the activity of the weak Lewis acid, the reaction temperature, the reaction time, and the precursor material. The relationship between these various factors can be determined experimentally in accordance with the teachings herein.

It can be understood that it may not be economically advisable to endeavor to obtain a high yield from the polymerization reaction of the invention. Additional steps as well as the use of the product obtained may influence the overall process.

The process according to the invention results in a mesophase pitch having a mesophase content as high as 100% by weight and yet the softening point is considerably lower than comparable mesophase pitch produced by thermal polymerization. Generally the softening is from 50° C. to 100° C. lower. A low softening point enables spinning operations to be at a relatively low temperature so that there is a reduced energy cost for the production of carbon fibers. The low melting point also minimizes the possibility for a thermal reaction during spinning and the formation of gases and high viscosity products. For certain purposes, it may be preferable to have a higher softening point. The softening point can be raised by reacting additionally and/or by distillation.

Another aspect of the instant invention is the formation of mesophase pitch using a combination of the instant process along with either solvent extraction or thermal polymerization. A precursor material can be transformed into a form which appears isotropic even though it contains mesophase components. A subsequent operation can be used to produce a mesophase pitch having a predetermined mesophase content. A two stage operation of this type may have attractive commercial value. Terminating the first stage even before the apparent formation of mesophase results in a material which will have little or no incidental formation of insoluble components or at least will be suitable for a filtering step to remove insolubles.

The reaction time as well as the reaction temperature can be determined experimentally for the selected precursor material in order to achieve a predetermined mesophase content or at least react the precursor material to a predetermined point suitable for subsequent steps for producing mesophase pitch.

Further objects and advantages of the invention will be set forth in part in the following specification and in part will be obvious therefrom without being specifically referred to, the same being realized and attained as pointed out in the claims thereof.

The illustrative, non-limiting examples of the practice of the invention are set out below. Numerous other examples can readily be evolved in the light of the guiding principles and teachings contained herein. Examples given herein are intended to illustrate the invention and not in any sense to limit the manner in which the invention can be practiced. The parts and percentages recited herein, unless specifically stated otherwise, refer to parts by weight and percentages by weight.

EXAMPLE 1

100 grams of naphthalene was reacted with 50 grams of anhydrous $AlCl_3$ and 25 grams of pyridine hydrochloride for 26 hours at a temperature of about 150° C. with continuous stirring. The reactants were then cooled and treated directly with water and concentrated hydrochloric acid in order to hydrolyze the reactants. This mixture was filtered and a solid pitch residue was obtained. This residue amounted to about 96% by weight yield. The residue was examined under polarized light microscopy and was determined to be isotropic.

The residue was then heated for 9 hours at a temperature of 420° C. under an argon atmosphere with continuous agitation. During the last four and a half hours the residue was sparged with argon at a slow rate in accordance with the prior art.

This treatment resulted in a mesophase pitch containing about 100% by weight mesophase and having a Mettler softening point of about 306° C. This mesophase pitch amounted to a 56% by weight yield. The mesophase pitch was found to be spinnable and was spun into monofilaments at a temperature of about 340° C.

This example shows how the instant process can be used to obtain a precursor material suitable for use in prior art processes.

EXAMPLE 2

The process as carried out in Example 1 was repeated on a number of materials as shown in Table I. For these materials, the second step involved heat treatment and a low degree of sparging. The precursor material used is shown in column one and the gram ratio of precursor material to anhydrous aluminum chloride to pyridine hydrochloride is given in column two. The time in hours and temperature are given in column three with the yields set forth in column four. Column five shows the time in hours and temperature for the second step with the yield from the second step and mesophase content of the product obtained given in column six and seven. The last column shows the softening point for a number of the materials.

Several of the starting compounds in Table I, specifically fluoranthene, fluorene, and p-terphenyl are known to produce either fine-domained mesophase or no mesophase at all when subjected to direct thermal polymerization without the acid treatment.

It is of interest that p-terphenyl which only contains singly condensed rings is also effective.

TABLE I

| Precursor Material (P.M) | Ratio of Reactants including P.M./$AlCl_3$/pyr. HCl. | Polymerization Time/Temp. hr./°C. | Yield % | Heat Treatment Time/Temp. hr./°C. | Yield % | Mesophase % | Soft. Pt. °C. |
|---|---|---|---|---|---|---|---|
| anthracene | 5/2/1 | 3.0/155 | 96 | 6/400 | 71 | 70 | — |
| fluoroanthene | 5/2/1 | 3.0/150 | 100 | 6/400 | 80 | 40 | — |
| fluorene | 10/4/2 | 6.0/150 | 75 | 20/400 | 23 | 50 | — |
| p-terphenyl | 10/5/2.5 | 26/150 | 86 | 12/420 | 30 | 40 | — |
| naphthalene | 15/8/4 | 6/150 | 91 | 24/400 | 34 | 80 | — |
| naphthalene and phenanthrene | 50/50/50/25 | 26/150 | 87 | 5/420 | 55 | 70 | 220 |
| naphthalene and phenanthrene | 125/125/125/62.5 | 26/150 | 86 | 6/420 | 63 | 50 | 248 |
| petroleum pitch | 250/125/62.5 | 26/160 | 94 | 8/390 | 80 | 80 | 276 |
| naphthalene and phenanthrene | 125/125/125/62.5 | 26/160 | 87 | 8/420 | 61 | 100 | 265 |

For each of these precursor materials, the pitch produced by the polymerization reaction of the invention was an isotropic pitch.

It is particularly interesting that the petroleum pitch resulted in a yield considerably higher than the 40% to 50% according to prior art thermal polymerization.

In addition, the softening point of the mesophase pitch produced from the petroleum pitch was considerably lower than the softening point of a thermally produced mesophase pitch.

EXAMPLE 3

250 grams of naphthalene was reacted with 125 grams of anhydrous $AlCl_3$ and 62.5 grams of pyridine hydrochloride for 26 hours at a temperature of 160° C. The cooled product was treated with water and hydrochloric acid and filtered. The solid residue obtained amounted to a 90% by weight yield and was melt filtered at a temperature of about 300° C. and a pressure of about 345 KPa through a porous (10 microns) stainless steel screen using nitrogen pressure.

The filtered pitch was heat treated in a reactor with stirring at a temperature of about 420° C. for eight hours. Argon was sparged through the pitch in accordance with the prior art. A mesophase pitch containing about 100% by weight mesophase and amounting to the yield of about 61% by weight was obtained. The mesophase pitch had a melting point of about 265° C. The surprising thermal stability of the mesophase pitch can be appreciated by Table II which shows evaluations made during the heat treatment after four hours, six hours, and eight hours for the yield, mesophase content, and softening point at each time.

TABLE 2

| Heat Treatment Time (hr.) | Effective Yield (%) | Mesophase Content (%) | Soft. Point (°C.) |
|---|---|---|---|
| 4 | 68 | 100 | 220 |
| 6 | 64 | 100 | 248 |
| 8 | 61 | 100 | 265 |

The final mesophase pitch (265° C. softening point) was spun into fibers having diameters of about 10 microns. The as-spun fibers were examined under polarized light and found to be highly anisotropic. An x-ray analysis of the as-spun fibers indicated a preferred orientation of about 42°.

The as-spun fibers were thermoset by first heating them in ozone at a temperature of from about 90° C. to about 100° C. for about 90 minutes and thereafter by heating them in air at 260° C. for about 60 minutes with the temperature being raised to 360° C. over a period of 60 minutes. The thermoset fibers were carbonized in accordance with conventional practices to a temperature of about 2400° C. The carbon fibers obtained had an average Young's modulus of about 434 GPa and an average tensile strength of about 2.17 GPa. Some carbon fibers had tensile strength up to about 3.45 GPa.

EXAMPLE 4

250 grams of petroleum pitch was reacted with 125 grams of anhydrous $AlCl_3$ and 62.5 grams of pyridine hydrochloride for 26 hours at a temperature of about 160° C. A yield of 94% by weight of an isotropic pitch was obtained. This pitch was melt filtered at a temperature of about 330° C. under nitrogen pressure of about 345 KPa through a 10 micron porous metal screen with diatomaceous earth. The filtered pitch was heat treated in a reactor at 390° C. for six hours with stirring while sparging with nitrogen through the pitch in accordance with conventional practices. The pitch obtained amounted to an 80% by weight yield and contained about 70% by weight mesophase. The softening point was about 269° C. This mesophase pitch was heated for an additional two hours at 390° C. so that the total time for the heat treatment was eight hours. The mesophase pitch produced contained about 80% by weight mesophase at a softening point of about 276° C. and amounted to a 97% by weight yield. The yield was 75% by weight as compared to the petroleum pitch. This mesophase pitch was spun at a temperature of about 300° C. into fibers having diameters of about 10 microns. The fibers were found to be anisotropic and the preferred orientation measured by x-ray analysis was about 35°.

The as-spun fibers were thermoset using the procedure of Example 3 and then carbonized to 2400° C. The carbon fibers obtained had diameters of about 8 microns and an average Young's modulus of about 345 GPa and tensile strength in the range of from about 1.63 GPa to about 2.07 GPa. The mesophase pitch showed good spinnability and the properties of the fibers obtained were good.

EXAMPLE 5

The process of the invention was carried out using a single treatment according to the invention to obtain a mesophase pitch.

A 10 gram sample of petroleum pitch was reacted with 5 grams of anhydrous $AlCl_3$ and 2.5 grams of pyridine hydrochloride for 4.5 hours at a temperature of about 225° C. The product obtained was subjected to hydrolysis and filtering to obtain a mesophase pitch having about 40% by weight mesophase. The mesophase pitch was a 75% by weight yield. The mesophase content was determined from photomicrographs of a sample which had been annealed at a temperature of about 350° C.

EXAMPLE 6

The reaction of Example 5 was repeated except that a temperature of about 250° C. was used for about 50 hours. The mesophase pitch produced constituted a 95% by weight yield and contained about 95% by weight mesophase. The softening point of the mesophase pitch was about 265° C.

The mesophase pitch was spun into fibers having diameters of about 10 microns. The spinnability of the mesophase pitch was excellent. The as-spun fibers were found to be anisotropic. The fibers were thermoset and carbonized to a temperature of about 2500° C. by conventional methods.

EXAMPLE 7

Example 6 was repeated except that a temperature of about 160° C. was used. No mesophase was produced by the reaction.

EXAMPLE 8

200 grams of petroleum pitch were reacted with 100 grams of anhydrous $AlCl_3$ and 50 grams of pyridine hydrochloride for 4.5 hours at a temperature of about 225° C. After hydrolysis and filtering, a yield of 98% by weight of a mesophase pitch was obtained. This mesophase pitch was heated to 300° C. and stirred for ½ hour under a nitrogen atmosphere without any sparging. The product obtained in a 98% by weight yield, had a softening point of about 242° C. and contained about 80% by weight mesophase.

EXAMPLE 9

20 grams of petroleum pitch were reacted with 5 grams of anhydrous $AlCl_3$ and 2½ grams of pyridine hydrochloride for 5 hours at a temperature of about 250° C. After hydrolysis and filtering, the mesophase pitch was obtained in a 95% by weight yield and contained about 100% by weight mesophase. The mesophase pitch had a melting point of about 284° C. The ratio of the petroleum pitch to $AlCl_3$ to pyridine hydrochloride in Example 9 was 4:1:0.5.

EXAMPLE 10

Example 9 was repeated except the ratio of reactants was changed to 8:1:0.5. The product obtained constituted a 95% by weight yield and had a softening point of about 180° C. This product contained about 5% by weight mesophase. Although the petroleum pitch had been polymerized, the mesophase content was not increased significantly because of the low ratio of reactants used.

This example shows how the variation in the ratio of reactants can influence the degree of mesophase formation.

EXAMPLE 11

A quantity of ethylene tar derived from the steam cracking of ethylene was subjected to distillation so that the components remaining generally had a boiling point greater than 370° C. 10 grams of this ethylene tar or pyrolysis tar was reacted with 5 grams of anhydrous $AlCl_3$ and 2.5 grams of pyridine hyrochloride for 5 hours at a temperature of about 150° C. The mesophase pitch obtained amounted to an 80% by weight yield and contained about 90% of large-domained mesophase.

EXAMPLE 12

The ethylene tar of Example 11 was not subjected to a distillation so that it contained components which boiled above about 200° C. 20 grams of this pyrolysis tar was reacted with 10 grams of anhydrous $AlCl_3$ and 5 grams of pyridine hydrochloride for 5 hours at a temperature of about 250° C. After hydrolysis with water and hydrochloric acid, a yield of 83% by weight was obtained. The product obtained was a mesophase pitch having a mesophase content of about 80% by weight and a softening point of about 243° C. The modified Conradson carbon content of the mesophase pitch was 74%. The same reaction was carried out for 6 hours at a temperature of 260° C. and produced a solid coke product which amounted to a 79% by weight yield and did not soften below a temperature of about 460° C. This product had a modified Conradson carbon value of about 92%.

The reaction according to the invention rearranges the molecules so that the modified Conradson carbon value increases. This is one of the reasons why the pitch produced by the invention is well suited for use as an impregnant or binder pitch for electrodes.

EXAMPLE 13

A pyrolysis tar different from the one used in Example 12 was subjected to distillation to remove material with a boiling point below about 370° C. at atmospheric pressure 10 grams of this distilled pyrolysis tar was reacted with 5 grams of anhydrous $AlCl_3$ and 2.5 grams pyridine hydrochloride for 2 hours at 150° C. After cooling, the mixture was hydrolyzed with water and hydrochloric acid. The product obtained in about 92% by weight yield was an isotropic pitch which melted at about 100° C. This pitch was heat treated at 400° C. for 5 hours and produced a mesophase pitch having domains greater than about 200 microns.

For comparison, the same pyrolysis tar after distillation was treated alone in accordance with prior art thermal polymerization processes. The product produced had mesophase domains of only about 20 microns.

A precursor material for producing needle coke or carbon fibers must be capable of producing mesophase domains much greater than 20 microns and preferably about 200 microns or greater. This Example shows that the process of the invention enables material to be useful for the production of needle coke or carbon fibers even though the same material would be unsuitable according to prior art processes.

EXAMPLE 14

10 grams of the pyrolysis tar of Example 13 which had been subjected to distillation was reacted with 5 grams of anhydrous $AlCl_3$ and 2.5 grams of pyridine hydrochloride for 3 hours at a temperature of about 200° C. After hydrolysis with water and hydrochloric acid, a 95% by weight yield was obtained. The product obtained had a mesophase content of about 15% by weight and a softening point of about 200° C.

This reaction was repeated for 3 hours at 230° C. and the product obtained amounted to a 95% by weight yield of large-domained mesophase and had a softening point of about 291° C.

This Example shows how the reaction temperature can be varied to produce different products.

EXAMPLE 15

40 grams of a decent oil produced from the catalytic cracking of petroleum was reacted with 20 grams of anhydrous $AlCl_3$ and 10 grams of pyridine hydrochloride for 5 hours at a temperature of about 200° C. After hydrolysis, a yield of about 95% was obtained. This product was a pitch having a softening point of about 40° C. The pitch was heat treated at 400° C. for 6 hours and gave about 50% by weight yield of large-domained mesophase pitch.

The same reaction with the decant oil was carried out for 5 hours at a temperature of about 230° C. and resulted in a pitch product having a yield of about 85% by weight and a softening point of about 198° C. The product obtained had a mesophase content of about 50% by weight.

In comparison, when the same decant oil is distilled according to conventional processes to produce a pitch the yield is only about 5% by weight.

EXAMPLE 16

The decant oil of Example 15 was reacted with the same amount of anhydrous $AlCl_3$ and pyridine hydrochloride for different periods of time and different temperatures to produce products having varying properties as shown in Table 3.

TABLE 3

| RUN NO. | TEMP./ TIME °C./Hrs. | YIELD % | SOFT. PT. °C. | MESO-PHASE CON-TENT % | MOD. CONRADSON CARBON CONT. % |
|---|---|---|---|---|---|
| 1 | 200/5 | 100 | 40 | 0 | 51 |
| 2 | 215/5 | 99 | 84 | 3 | — |
| 3 | 230/4 | 96 | 85 | 5 | 52 |
| 4 | 230/5 | 84 | 197 | 50 | 64 |
| 5 | 230/16 | 80 | 199 | 70 | 69 |
| 6 | 230/21 | 79 | 212 | 60 | — |
| 7 | 250/17 | 76 | coke | — | 95 |

Table 3 shows that the reaction can be controlled by varying time and temperature to produce a pitch which is isotropic or contains a low amount of mesophase or to produce a mesophase pitch or a coke. The non-mesophase pitches can be used as impregnant or binder pitches for electrodes.

The products from Runs 2 and 3 are interesting because the reprecipitated mesophase converted to an isotropic phase at about 300° C.

EXAMPLE 17

200 grams of the decant oil of Example 17 was reacted with 100 grams of anhydrous $AlCl_3$ and 50 grams of pyridine hydrochloride for 24 hours at a temperature of about 238° C. After hydrolysis, a 79% by weight yield of mesophase pitch was obtained. The mesophase pitch had a mesophase content of about 95% by weight and a softening point of about 231° C.

This mesophase pitch was heat treated with stirring and sparging at about 390° C. to produce a pitch which amounted to 66% by weight yield and contained about 100% by weight mesophase. The softening point was about 321° C.

EXAMPLE 18

A 20 gram portion of the petroleum pitch used in Example 5 was reacted with 10 grams of anhydrous $AlCl_3$ and 5 grams of aniline hydrochloride for 3 hours at a temperature of 230° C. with the reactants being stirred. After cooling, the mixture was treated with water and concentrated hydrochloric acid and filtered to provide a solid product which amounted to about 97% by weight yield. This product contained about 100% by weight mesophase when examined on a microscope hot stage and had a Mettler softening point of about 266° C.

The same reaction was carried out for 5 hours at a temperature of about 250° C. and resulted in a yield of about 96% by weight of a coke product which did not soften below 450° C.

The use of aniline hydrochloride is economically advantageous because the reaction can be carried out at a lower temperature and a shorter time period than pyridine hydrochloride.

EXAMPLE 19

The pitch of Example 10 was extracted with toluene. The insolubles obtained in 47% yield was found to soften at 311° C. and contain about 95% mesophase. Since direct extraction of the precursor pitch with toluene gives only about a 5% yield of mesophase, it is obvious that the chemical treatment had been effective in producing mesophase components.

I wish it to be understood that I do not desire to be limited to the exact details described herein, for obvious modifications will occur to a person skilled in the art.

Having thus described the invention, what I claim as new and desire to be secured by Letters Patent is as follows:

1. A method of producing a pitch or a coke, comprising reacting a polynuclear aromatic hydrocarbon containing at least 1 condensed ring with anhydrous $AlCl_3$ and an acid salt of an organic amine which acid salt reduces the activity of the $AlCl_3$, and is miscible with the $AlCl_3$ to form a molten eutectic salt mixture reactive with the aromatic hydrocarbon.

2. The method of claim 1, wherein the reaction is carried out at a temperature and for a time period to produce a pitch suitable for use as a binder pitch for the production of an electrode.

3. The method of claim 1, wherein the reaction is carried out at a temperature and for a time period to produce a mesophase pitch.

4. The method of claim 1, further comprising the step of hydrolyzing and filtering the product produced by the reaction.

5. The method of claim 1, wherein the reaction is terminated at a point when the product produced by the reaction has a softening point of about 120° C. or less and a modified Conradson carbon content of at least about 50%.

6. The method of claim 1, wherein the acid salt is selected from the group consisting of pyridine hydrohalides, aniline hydrohalides, and methylamine hydrohalides.

7. The method of claim 1; further comprising the steps of obtaining the product of the reaction, hydrolyzing the product, filtering the hydrolyzed product to obtain a residue, and subjecting the residue to an additional treatment to produce mesophase pitch.

8. The method of claim 1, wherein the reaction is carried out at a temperature and for a time period to produce a coke.

9. The method of claim 1, wherein the aromatic hydrocarbon contains two condensed rings.

10. The method of claim 9, wherein the reaction is carried out at a temperature and for a time period to produce a pitch suitable for use as a binder pitch for the production of an electrode.

11. The method of claim 9, wherein the reaction is carried out at a temperature and for a time period to produce a mesophase pitch.

12. The method of claim 9, further comprising the step of hydrolyzing and filtering the product produced by the reaction.

13. The method of claim 9, wherein the reaction is terminated at a point when the product produced by the reaction has a softening point of about 120° C. or less and a modified Conradson carbon content of at least about 50%.

14. The method of claim 9, wherein the acid salt is selected from the group consisting of pyridine hydrohalides, aniline hydrohalides, and methylamine hydrohalides.

15. The method of claim 9, further comprising the steps of obtaining the product of the reaction, hydrolyzing the product, filtering the hydrolyzed product to obtain a residue, and subjecting the residue to an additional treatment to produce mesophase pitch.

16. The method of claim 9, wherein the reaction is carried out at a temperature and for a time period to produce a coke.

* * * * *